US009699575B2

(12) United States Patent
van Halteren

(10) Patent No.: US 9,699,575 B2
(45) **Date of Patent: *Jul. 4, 2017**

(54) HEARING AID DEVICE

(71) Applicant: Sonion Nederland BV, Hoofddorp (NL)

(72) Inventor: Aart Zeger van Halteren, Hobrede (NL)

(73) Assignee: Sonion Nederland BV, Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/975,922

(22) Filed: Dec. 21, 2015

(65) Prior Publication Data

US 2016/0105752 A1 Apr. 14, 2016

Related U.S. Application Data

(63) Continuation of application No. 14/142,267, filed on Dec. 27, 2013, now Pat. No. 9,226,085.

(Continued)

(51) Int. Cl.
*H04R 25/00* (2006.01)
*H04R 25/02* (2006.01)

(52) U.S. Cl.
CPC ..... *H04R 25/604* (2013.01); *H04R 25/02* (2013.01); *H04R 25/652* (2013.01); *H04R 25/48* (2013.01); *H04R 2460/11* (2013.01)

(58) Field of Classification Search
CPC H04R 25/654; H04R 25/652; H04R 2460/11; H04R 2225/77; H04R 25/456;

(Continued)

(56) References Cited

U.S. PATENT DOCUMENTS 4,548,082 A 10/1985 Engebretson et al.
4,972,488 A * 11/1990 Weiss ..... H04R 25/654 381/322

(Continued)

FOREIGN PATENT DOCUMENTS

| | | |
|---|---|---|
| EP | 0684750 | 11/1995 |
| EP | 1853091 | 11/2007 |
| WO | 2012/006383 | 1/2012 |

OTHER PUBLICATIONS

European Search Report issued in European Patent Application No. 13199320 dated Apr. 10, 2014 (3 pages).

*Primary Examiner* — Davetta W Goins
*Assistant Examiner* — Phylesha Dabney
(74) *Attorney, Agent, or Firm* — Nixon Peabody LLP

(57) ABSTRACT

A hearing aid device comprising a receiver unit arranged in a compartment in a shell, wherein the shell comprises a venting passage between first and second opposite faces of the shell to provide air passage from one side of the shell to another, and wherein the shell comprises an opening in the first face into the compartment and a closing member positioned to close off the compartment. The opening is shaped to allow the receiver unit to be inserted into the compartment through the opening, and the compartment is acoustically connected to the venting passage to allow the sound to emit through the venting passage. The receiver unit may be releasably mounted in the compartment such that the receiver unit can be retracted from the shell through the opening.

22 Claims, 3 Drawing Sheets

Related U.S. Application Data

(60) Provisional application No. 61/747,040, filed on Dec. 28, 2012.

(58) Field of Classification Search
CPC .... H04R 25/48; H04R 25/604; H04R 25/658; H04R 11/02; H04R 1/10; H04R 1/1016; H04R 2201/10; H04R 2209/026; H04R 2225/63; H04R 25/554; H04R 25/06; H04R 25/02
USPC ..... 381/316, 322, 324, 325, 328; 181/135
See application file for complete search history.

(56) References Cited

U.S. PATENT DOCUMENTS 5,327,500 A * 7/1994 Campbell ..... H04R 25/654 381/322
5,535,282 A * 7/1996 Luca ..... H04R 25/654 381/322
5,606,621 A 2/1997 Reiter et al.
5,970,157 A * 10/1999 Yoest ..... H04R 25/654 381/324
6,164,409 A * 12/2000 Berger ..... H04R 25/654 128/864
6,788,796 B1 9/2004 Miles et al.
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,016,512 B1 3/2006 Feeley et al.
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,590,255 B2 9/2009 Nielsen
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 * 10/2010 Van Halteren ..... H04R 9/063 381/312
7,899,203 B2 3/2011 Van Halteren et al.
7,912,240 B2 * 3/2011 Madaffari ..... H04R 9/025 181/144
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
7,983,434 B2 7/2011 Rohrlein
8,098,854 B2 1/2012 van Halteren et al.
8,101,876 B2 1/2012 Andreasen et al.
8,103,039 B2 1/2012 van Halteren et al.
8,135,163 B2 * 3/2012 Blanchard ..... H04R 3/14 381/349
8,150,082 B2 * 4/2012 Saito ..... H04R 25/60 381/189
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,265,316 B2 * 9/2012 Saltykov ..... H04R 25/654 381/325
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,333,260 B1 * 12/2012 Hall ..... H04R 1/1016 181/130
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
9,226,085 B2 * 12/2015 van Halteren ..... H04R 25/652
9,301,063 B2 * 3/2016 Schmidt ..... H04R 25/608
2001/0043708 A1 * 11/2001 Brimhall ..... H04R 25/456 381/328
2003/0174846 A1 9/2003 Niederdrank
2005/0074138 A1 * 4/2005 Saltykov ..... H04R 25/456 381/322
2005/0190940 A1 * 9/2005 Ach-Kowalewski H04R 25/652 381/330
2006/0153418 A1 * 7/2006 Van Halteren ..... H04R 9/063 381/396
2007/0206826 A1 9/2007 Roehrlein
2008/0095390 A1 4/2008 Gebert et al.
2010/0040250 A1 * 2/2010 Gebert ..... H04R 25/654 381/316
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.

* cited by examiner

HEARING AID DEVICE

REFERENCE TO RELATED APPLICATIONS

This application is a continuation of U.S. application Ser. No. 14/142,267, filed Dec. 27, 2013, and titled "Hearing Aid Device," now allowed, which claims the benefit of U.S. Provisional Patent Application Ser. No. 61/747,040, filed Dec. 28, 2012, and titled "Hearing Aid Device," each of which is hereby incorporated by reference herein in its entirety.

FIELD OF THE INVENTION

The present invention relates to a hearing aid device comprising a receiver unit arranged in a compartment in a shell, and wherein the shell comprises a venting passage between first and second opposite faces of the shell to provide air passage from one side of the shell to another.

BACKGROUND OF THE INVENTION

Custom hearing aid devices comprise a shell or ear mold custom fit and molded to the ear canal of each individual user. Such hearing aid devices are therefore quite expensive as well as time consuming to make. The receiver in such hearing aids is normally mounted on a tube that goes to a sound outlet facing the internal ear of the user and placed next to the opening of a vent or venting passage traversing the shell primarily placed to allow for reduction of the occlusion effect.

Unfortunately, the receiver not uncommonly needs to be repaired or replaced for instance due to a malfunction, in which case the shell of the hearing aid device is to be cracked open and built again. Also, current wax protection systems have proven insufficient to completely prevent ear wax from entering the receiver causing the receiver to fail and to be completely replaced. In prior art of ITE hearing aids, the receiver has only been replaceable from a rear portion or so-called faceplate portion of the aid where a substantially plane premanufactured plastic plate has been glued to the upper circumferential portion of the hearing aid shell so as to isolate the interior of the hearing aid from the surrounding environment. Accordingly, to replace the defective receiver, the faceplate portion of the aid had to be reopened with a substantial risk of damaging the customized ITE shell and/or mechanical or electronic components housed within the shell. This furthermore is both very expensive and takes a lot of time, and mechanical fitting problems may be difficult or impossible to avoid.

A further problem with custom hearing aid devices is the space concern as the two openings of the receiver (the sound outlet) and of the vent, respectively, unavoidably takes up a lot of valuable space contrary to the general objective of making the tip of the hearing aid as small as possible. The space and size requirements likewise impose strict limitations on the size of the opening of the receiver which may otherwise be desirable to make bigger or longer in order to improve the sound output in certain frequency intervals. For example, in some applications, the vent takes about as much space on the tip as the receiver and the aspect ratio of the receiver, width and thickness, are adapted to make space for the vent.

SUMMARY OF THE INVENTION

It is one object of the embodiments of the present invention to overcome or at least reduce some or all of the above described disadvantages of the known hearing aids by providing a hearing aid with improved possibilities for repairing or exchanging the receiver.

It is a further object of the embodiments of the invention to provide a hearing aid device with improved ear wax protection for the receiver and to make easier cleaning of the hearing aid device possible.

It is a yet further object of the embodiments of the invention to provide a hearing aid device for insertion into the ear canal where the size or the tip can be reduced if so desired.

A further object of the embodiments of the invention is to provide a hearing aid device where it is possible to change the acoustical output of the device, for example, to create different peak(s), both in frequency and damping and to get a wider bandwidth.

In accordance with the invention, a hearing aid device comprises a receiver unit arranged in a compartment in a shell, wherein the shell comprises a venting passage between first and second opposite faces of the shell to provide air passage from one side of the shell to another, and wherein the shell comprises an opening in the first face into the compartment and a closing member positioned to close off the compartment. The opening is shaped to allow the receiver unit to be inserted into the compartment through the opening. Further, the compartment is acoustically connected to the venting passage such that sound emitted by the receiver unit is guided from the compartment and out of the shell via the venting passage.

Due to this invention, the receiver unit can be inserted and placed in the shell from the outside and without having to close the shell around the receiver. Likewise, the receiver can be retracted and optionally replaced without needing to open the shell. The invention thus provides for the receiver to be both inserted, retracted and optionally reinserted more easily, faster, and with no or minimal risk of damaging the hearing aid shell. The invention may thereby provide for a more simple and uncomplicated, faster and more economical manufacture and preparation of the hearing aid device.

At the same time, an improved wax protection is obtained for the receiver unit as the receiver unit is enclosed in the compartment with no direct opening to the exterior. Instead, wax may only potentially reach the receiver unit after having passed at least a part of the venting passage. The hearing aid device according to the invention further opens up for different possibilities for the placing of wax protection means while still protecting the receiver unit.

Further, even if or when car wax has entered the receiver unit, but has not yet reached the spout of the receiver, the receiver unit can be removed through the opening, cleaned and replaced in the hearing aid. Even relatively rough mechanical means may be used for cleaning since one can stay away from the spout of the receiver.

The wax protection mechanism may optionally be integrated as a part of the receiver unit. Hereby, by retracting the receiver unit from the compartment through the opening, access is obtained to the wax protection mechanism which may then easier be cleaned or replaced as need be.

The shell or housing may comprise the entire or a part of the ear mold such as a customized ITE/ITC/CIC housing. Such shells or housings must have very small dimensions of the parts positioned in the ear canal of the user and may be shaped to fully or partly fit in some part of the ear canal of the user. The present invention facilitates the providing of very small hearing aid devices.

In addition, the shell may comprise a wall part comprising a plurality of through-going electrical conductors separating the compartment and a second compartment. Thus, the receiver unit could be positioned in the first compartment and the second compartment could comprise battery, amplifier, other miniature transducer/loudspeakers, etc. Then, also, any electrical contacts and any fixing means could be attached to or integral with this wall part separating the two compartments.

Further, the shell could have outer dimensions adapted to the dimensions of an ear canal of a specific person and wherein inner dimensions of the compartment are adapted to the person's hearing problems. This is due to the fact that receiver units may be made so small that excess space is available. This space may be used for acoustically adapting the hearing aid device to the particular person and the particular hearing problems of that user.

The receiver unit may comprise one or more receivers in a module, such as placed in a casing, or may be made up the one or more receivers as such.

Here and throughout the description, the receiver unit comprises one or more receivers/loudspeakers/transducers applicable for hearing aids i.e. miniature receiver/loudspeaker/transducer which may characterized by having an extend, in the plane of the diaphragm, over an area of less than 4.0×4.0 mm, such as 3.5×3.5 mm, or even more preferably less than 3.0×3.0 mm. Alternatively or additionally, a miniature receiver/loudspeaker/transducer comprises a so-called MEMS based transducer element, which is a transducer element wholly or at least partly fabricated by application of Micro Electro-Mechanical Systems Technology.

The receiver unit may comprise one or more receivers such as e.g. a combination of Woofer/Tweeter in two general receivers, a dual receiver or a single receiver. A single receiver may prove advantageous especially if vibrations of the receiver is not or only a minimal problem for instance if the receiver is properly suspended e.g. with resilient suspensions to suppress or attenuate mechanical vibrations of the receiver.

The receiver unit may be connected or mounted to the compartment of the shell by hard mounting i.e. mounted without resilient suspension, such as a mounting or connection of the receiver using glue, welding, soldering or the like. Additionally or alternatively, the receiver unit may be mounted by means of resilient suspensions or supports such as elastomeric rubber boots and elastomeric strips or ribbons mounted to partly or fully encircle the receiver unit, shock absorbing protrusions etc.

In an embodiment of the invention, the receiver unit is releasably mounted in the compartment such that the receiver unit can be retracted from the shell through the opening. The receiver unit may advantageously be mounted in the compartment by any means allowing for the receiving unit to be retracted or removed, e.g. by clicking, form locking, or by gluing by means of a glue breaking or cracking when the receiver unit is retrieved. Hereby, the receiver unit can be retracted and optionally re-inserted from the compartment and thereby from the shell one or more times with no or minimal risk of damaging the shell by the operation. Also, the means for releasably mounting or fixing the receiver unit to the compartment may be operable by engaging the compartment and/or the receiver unit from outside the compartment and/or receiver unit. These fixing means could comprise one or more of a snap lock, a thread, a bayonet coupling, a key way, and snap taps.

The one or more receivers may be mounted in the receiver unit, or may as a part of the receiver unit be mounted or connected to the compartment of the shell. The one or more receivers may be hard mounted i.e. mounted without resilient suspension, such as a mounting or connection of the receiver using glue, welding, soldering or the like. Additionally or alternatively, the one or more receivers may be mounted by means of resilient suspensions or supports such as elastomeric rubber boots and elastomeric strips or ribbons mounted to partly or fully encircle the receiver, shock absorbing protrusions etc.

In one embodiment, the compartment and the receiver unit comprise mating electrically conducting contact means adapted to provide solderless/solderfree, electrical conduction between the contact means of the compartment and the receiver unit. Such conduction may be provided by abutting the electrically conducting means, preferably using a physical biasing in order to ensure contact during thermal changes, vibrations etc. Alternatively, a more fixed engagement (using a thread or other mechanically engaging parts) may be used. Preferably, the engagement is detachable in a non-destructive manner.

The electrically conducting contact means may be adapted to provide a sliding or resilient, electrically conducting contact means. The electrically conducting contact means could comprise an electrically conducting spring, such as a helical, torsion, or leaf spring. Alternatively or additionally, the resilient electrically conducting contact means could comprise electrically conducting foam (such as polymeric foam with a surface covering of an electrically conducting material), a web (of an electrically conducting material) or the like.

By mounting the one or more receivers directly to the hearing aid device shell and electrically connected through the use of engaging/abutting/biasing contacts inside the compartment forming an acoustical chamber, a significant size of the internal volume in the acoustic chamber can be obtained inside a shell of a small ITE/ITC/CIC type of hearing aid device.

Alternatively or additionally, the electrical signals from the hearing aid amplifier to the receiver may be provided through for example a pair of flexible electrical leads such as multi-core litze wires soldered to respective terminals of the receiver.

The venting passage may be straight or non-straight, and may comprise any sort of passage or channel at least going from one side of the shell to the other allowing for the air pressure to be partly or fully equalized on each side of the hearing aid shell when in use. The venting passage may comprise a tube of uniform or varying cross sectional area and may comprise one or more branches. The venting passage may be shaped or formed or of length intervals with a view to affect or design the acoustical output of the hearing aid device. The length of a venting passage may be between 3-35 mm, such as between 5-25 mm, such as preferably between 8-22 mm.

As the compartment is acoustically connected to the venting passage so that sound emitted by the receiver unit is guided from the compartment and out of the shell via the venting passage, at least a part of the venting passage forms part of the acoustical channel from the receiver unit to the venting passage outlet. The acoustic channel is an acoustic transmission line between the port or spout of the receiver unit and the acoustic outlet i.e. the venting passage outlet.

Such acoustic channel may be advantageous in providing the possibility to affect the emitted sound differently than for a receiver operating directly into the ear canal (that is, where the acoustic channel is nonexistent or provided only by the formed metal tube typically attached to the port of receivers). Such custom devices have at least one peak at the mechanical resonance frequency of the receiver, generally around 3 kHz. A second resonance may occur at or above 10 kHz caused by the effective inertance of the air in the port (and residual acoustic channel of the metal tube, if present) resonating with the effective compliance of the front volume. A deep valley exists between the two response peaks exhibited by these resonances.

It is often desirable to have a lower peak-to-valley ratio which may be obtained by the introducing of an acoustic channel as according to the present invention. In a simple analysis, this acoustic transmission line can be represented by a simple inertance (mass), which allows for shifting the frequency of the acoustic resonance by adding inertance to the system, by means of an acoustic channel.

The acoustic channel creates an additional acoustic load upon the receiver, thereby modifying its output. These two points of view (channel modifies receiver through loading, or channel modifies acoustic output through the transmission line) are consistent with and mathematically equivalent to each other.

The acoustic channel (viewed as a transmission line) will introduce a time delay between the acoustic outlet and the port, equal to the effective length of the acoustic channel divided by the speed of sound. This provides a definition of the effective length of the acoustic channel. An acoustic channel with a relatively small cross-sectional dimension that is much larger than a wavelength can be considered lossless, meaning that the sound will not attenuate as the wave propagates down its length. However, at smaller dimensions, the acoustic wave begins to exchange heat with the walls of the acoustic channel, thereby attenuating the wave. This is exhibited in the frequency response as reduced amplitude of the acoustic peaks and is identified as damping.

To a reasonable degree of accuracy, the behavior of the acoustic channel can be represented by a lossy transmission line parameterized by its cross-sectional area and length. Thus, area and length of the channel are independently important in the design of the acoustic channel. An acoustic channel with area that varies with length can be segmented and represented by a series of transmission lines; other analysis methods also exist. By varying the area along the length of the channel, the acoustic channel may also be designed to act at least partially as an acoustic impedance matching element between the port and the acoustic impedance presented at the outlet.

Cross sectional areas and lengths of different segments of the acoustic channel may be chosen to provide a desirable wide bandwidth response and peak-to-valley ratios of the hearing aid device and thereby determine the acoustic output. Further, the material parameters (such as the flexibility and hardness) of the acoustic material may be chosen or varied along the length to yield the desired output.

In an ITE device, the acoustic channel may be 0.4-4 mm in diameter such as approximately 1-2 mm in diameter, and of a length of 2-20 mm, such as between 3 mm and 10 mm in length.

In an embodiment of the invention, the compartment is acoustically connected to the venting passage via an acoustical channel segment joining the venting passage at a distance from the first face of 1-9 mm, such as 2-7 mm. By the joining of the channel segment to the venting passage at some distance is obtained that the total length of the acoustic channel can be determined and decided upon to yield a specific output of the hearing aid device.

In an embodiment of the invention, the acoustical channel segment has a length 0.1-10 mm, such as of 0.2-5 mm, such as of 0.2-1 mm. Hereby the length of the acoustical channel may be determined and chosen according to the desired output of the hearing aid. Hereby, the total length of the acoustic channel can be determined and decided upon to yield a specific output of the hearing aid device by adding some length to the acoustic channel segment between the compartment and the venting passage. The acoustic channel segment may be made of a flexible material allowing for the channels segment to be twisted, bent or turned to fit and be placed in even a minimal space available in the shell. Hereby even significant lengths may be obtained if desired. The channel may e.g. be made of SLA or a plastic material. Alternatively, the acoustic channel segment may be made as short as possible as determined by the wall thickness between the compartment and the venting passage.

In an embodiment of the invention, the acoustical channel segment further comprises wiring for electrical connections to the receiver unit. Hereby any electric wiring may be guided from the compartment via the acoustical channel segment into the venting passage. In this way, the acoustic channel segment and parts of the venting passage may be used for holding and guiding the wiring.

By the hearing aid device according to the invention, the position and orientation of the sound outlet or spout of the receiver can be chosen with a large degree of freedom. Hereby the spout position and orientation can be chosen such as to obtain an acoustic channel of a desired length and thereby influence the output of the hearing aid.

In an embodiment, the receiver unit comprises a sound outlet oriented in a direction away from the first face. The receiver unit may be arranged such that the sound outlet or spout is oriented in a direction opposite to the opening or in a direction away from the opening or the first face of the shell. Alternatively or additionally, the sound outlet or spout of the receiver unit may be oriented in a direction towards the second face of the shell.

According to an embodiment of the invention, the closing member comprises a lid or a plug releasably attached to the shell. The closing member may e.g. be attached by means of clicking, form locking, or by a glue allowing to be broken or cracked up if the closing member is to be removed. Alternatively, the closing member may be attached to the shell by e.g. a snap lock, a thread, a bayonet coupling, a key way, or snap taps. Hereby, the closing member closes off the compartment acoustically to ensure the sound is guided from receiving unit into the venting passage and out of the hearing aid device. Further, the closing member closes off the compartment physically protecting the receiver unit from the environment and entrance of ear wax through the opening. Furthermore, the closing member may be equipped with electrical connectors for providing electrical connection when engaging the shell.

In an embodiment of the invention, at least a part of the receiver unit functions as the closing member. Hereby, the hearing aid device may be manufactured by fewer parts which may enable a more simple and fast assembling of the hearing aid device.

In an embodiment of the invention, the receiver unit is attached to the closing member. The receiver unit may e.g. be press fitted, glued or attached by means of clicking, threads, snap locks or the like. Hereby, the receiver unit may be attached to the closing member first and thereafter inserted into the compartment of the shell, during which operation the closing member may optionally function as a handle for easier or more secure grip on or guidance of the receiver unit.

In a further embodiment of the invention, the compartment is placed at least partly next to a part of the venting passage such that a part of a wall of the compartment forms a part of a wall of the venting passage. Hereby, the acoustic channel segment between the compartment and the venting passage can be kept as short as possible. Further, the size of the shell may hereby be reduced, especially reducing the dimensions needed of tip of the hearing aid. Additionally, this reduction of the required space results in more space available in the tip part of the hearing aid, for example for a bigger opening of the venting passage, which may be advantageous to get a wider bandwidth of the output.

According to an embodiment of the invention, the hearing aid comprises a damper placed in the venting passage between the second face and the acoustical channel segment to the compartment. As the acoustical output from the receiver unit is guided out of the hearing aid via a part of the venting passage, this allows for the placing of a damper at more positions in the venting passage and thereby yielding the possibility to influence the acoustical performance of the hearing aid.

In one embodiment, a wax protection mechanism is placed in the venting passage between the first face and the acoustical channel segment to the compartment or in the acoustical channel segment from the compartment to the venting passage. Hereby, the wax protection mechanism may be placed such as to protect both the venting passage as well as the compartment with the receiver unit. The wax protection mechanism can be placed in different positions, but preferably at the connection to the venting passage, as an extra security for the receiver unit. Hereby, the wax protection mechanism may be placed some distance away from the outlet or spout of the receiver unit thereby yielding the possibility to take out the receiver unit the compartment and clean the device effectively and more easily from wax without or with only reduced risk of getting close to the more sensitive parts of the receiver unit. As this is not or only a minor issue, more rough means for cleaning may optionally be employed without risk of damaging the receiver unit.

Additionally, more protection means may be placed at different positions.

In an embodiment, the wax protection mechanism comprises a filter thereby effectively preventing wax from entering or getting too close to the receiver unit.

The acoustic connection of the receiver unit to the venting passage can be guided by e.g. a piece of tubing. Hereby, an easy or simple connection between the receiver unit and the venting passage may be obtained. The tubing may further be used to create different peak(s), both in frequency and damping. Further, the tube can be easily replaceable if at some time filled with wax.

Alternatively, the acoustic connection of the receiver unit can be free or open i.e. the spout or receiver output may be in open connection with the compartment having an opening to the venting passage. In this way, the sound goes through the spout opening into the extra volume between the compartment and the receiver into the venting passage.

The hearing aid may have more acoustical openings between the compartment and the venting passage. Hereby, it is possible to make a so-called Thuras tube where at least a part of the output of the backside of the receivers is guided back to the front volume of the receiver unit through a long tube in the range of 40-90 mm. Hereby, a higher output at e.g. 500 Hz-1 kHz with very little low frequencies may be obtained. Further, 5-6 dB more output in certain frequency areas may be obtained, likewise increasing the efficiency by approximately 3 dB.

Finally, the invention relates to a hearing aid according to any of the above, wherein at least of part of the shell is adapted to be inserted in an car canal of a user with the first face facing towards the interior ear and the opposite second face facing towards the surroundings.

DETAILED DISCLOSURE OF THE DRAWINGS

Figure 1:
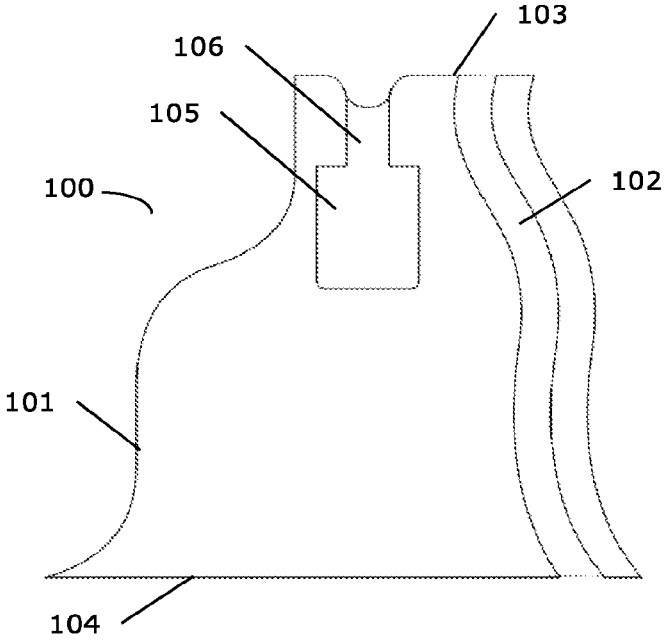
Fig. 1 (prior art)
FIG. 1 illustrates in a cross-sectional view a vented hearing aid device according to prior art.

FIG. 1 illustrates a hearing aid device 100 according to the prior art and as seen in a cross sectional view. The hearing aid device 100 comprises a shell 101 molded to fit in the ear canal of a user with a first face 103 or tip part facing the interior ear and an opposite second face 104 facing toward the exterior. The shell 101 comprises a venting passage 102 between the first face 103 and the second face 104 of the shell 101 to provide an air passage from one side of the shell to the other. According to prior art hearing aid devices, the receiver unit 105 is then placed with a sound outlet 106 next to the venting passage 102.

Figure 2:
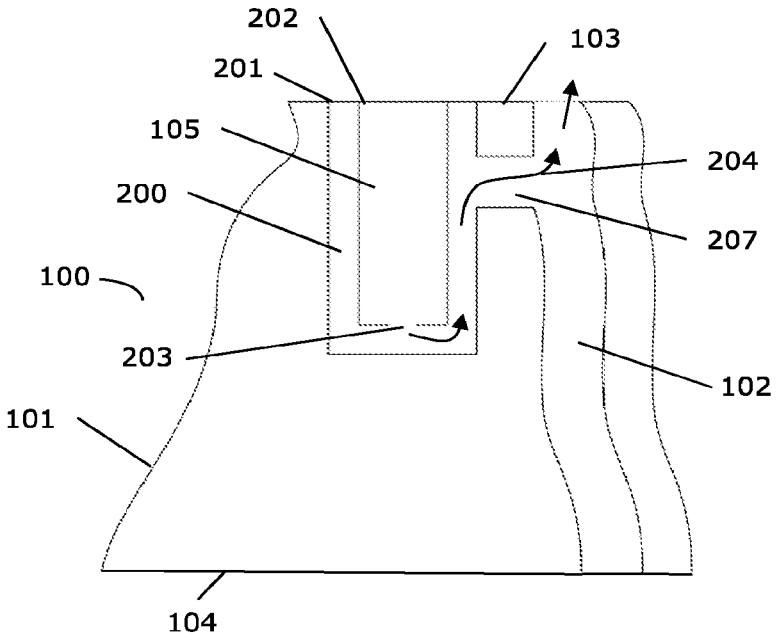
FIG. 2 illustrates in a cross-sectional view an embodiment of a hearing aid device according to the invention.

FIG. 2 shows a sketch of a hearing aid device 100 according to the invention and as seen in a cross sectional view. Here, the hearing aid device 100 comprises a receiver unit 105 arranged in a compartment 200 in a shell 101. The shell 101 comprises a venting passage 102 between first face 103 and second face 104 of the shell 101 to provide air passage from one side of the shell to another. The shell further comprises an opening 201 in the first face into the compartment 200 and a closing member 202 positioned to close off the compartment. The opening 201 is shaped to allow the receiver unit 105 to be inserted into the compartment 200 through the opening. The receiver unit 105 may therefore likewise be retracted through the opening 201 without necessarily having to crack open the shell. The compartment 200 is acoustically connected to the venting passage 102 such that sound emitted by the receiver unit output or spout 203 is guided from the compartment and out of the shell via the venting passage as indicated by the arrows 204. The positioning of the receiver unit therefore both allows for a simple mounting or assembly of the hearing aid by insertion of the receiver unit through the opening, and at the same time allows for an increased protection of the receiver unit as ear wax, dirt and the like is likely to get stuck somewhere in the venting passage without entering the compartment. The construction furthermore allows for more and better places to arrange ear wax protection mechanism, such as, for example, in or near the opening of the venting passage thereby protecting both the venting passage and the receiver unit in one. In another embodiment, the closing member 202 is a flex/PCB with a biocompatibility layer at the outer side. In this case, the PCB is directly connected and integrated with the receiver unit and so provides both electrical connection means as mechanical closing means.

The receiver unit may optionally comprise or consist of a dual receiver. The dual receiver may then optionally be hard mounted in the compartment. Alternatively or additionally, the hearing aid device may comprise resilient suspensions placed between the receiver unit and the wall of the compartment.

The acoustic output is guided from the receiver unit in the compartment into the venting passage 102 via an acoustic channel segment 207. This may comprise a piece of tubing or may be formed by walls of the shell. The acoustic channel hereby is formed by the acoustic channel segment and the outermost part of the venting passage.

In FIG. 2, the output or spout 203 of the receiver unit is arranged in a direction away from the opening into the compartment or in a direction away from the first face 103 of the shell. The spout 203 may alternatively be arranged in another direction relative to the venting passage such as facing the venting passage 102.

Figure 3:
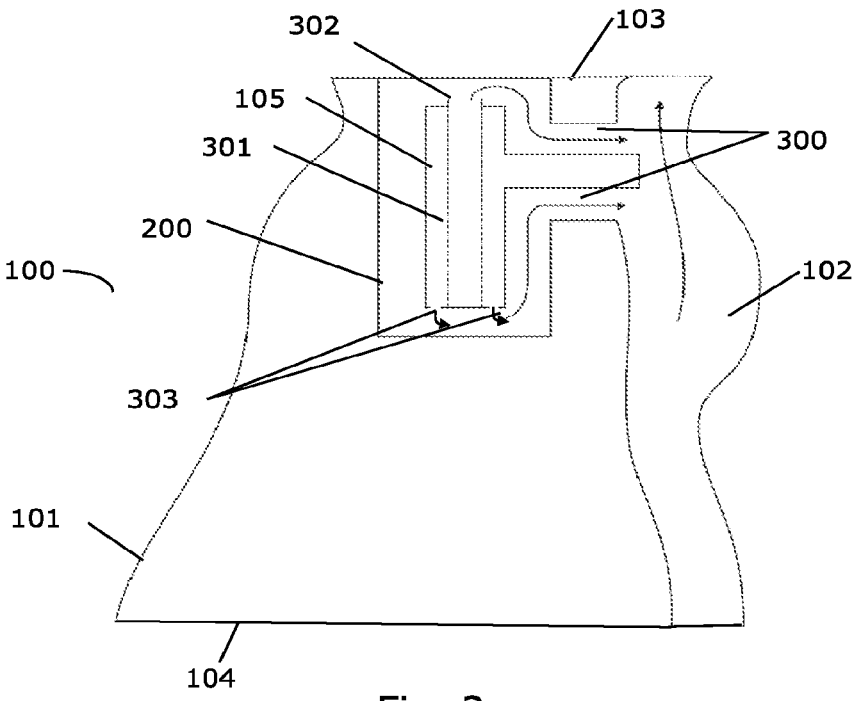
FIG. 3 shows in a cross-sectional view a sketch of another hearing aid device according to the invention.

FIG. 3 illustrates a hearing aid device with two acoustical openings or passages 300 between the compartment 200 and the venting passage 102. The receiver unit 105 here comprises a dual receiver 301 with a front volume opening 302 and a back volume opening 303. Because of the two acoustic channel segments 300, a so-called Thuras tube is formed where at least a part of the output of the receiver passes between the front and back volume openings. This may be used to obtain a higher output at e.g. 1 kHz with very little low frequencies. Further, 5-6 dB more output in certain frequency areas may be obtained, likewise increasing the efficiency by approximately 3 dB. The effect of the Thuras tube is dependent on the lengths of the different parts of the acoustic channel and thereby on the length of the acoustic channel segments 300 between the compartment and the venting passage. In a particular application, the acoustic channel segments may be adapted to actually cancel the low frequencies and only output the high-frequencies. This may be advantageous for users only suffering from high-frequency hearing loss.

Figure 4:
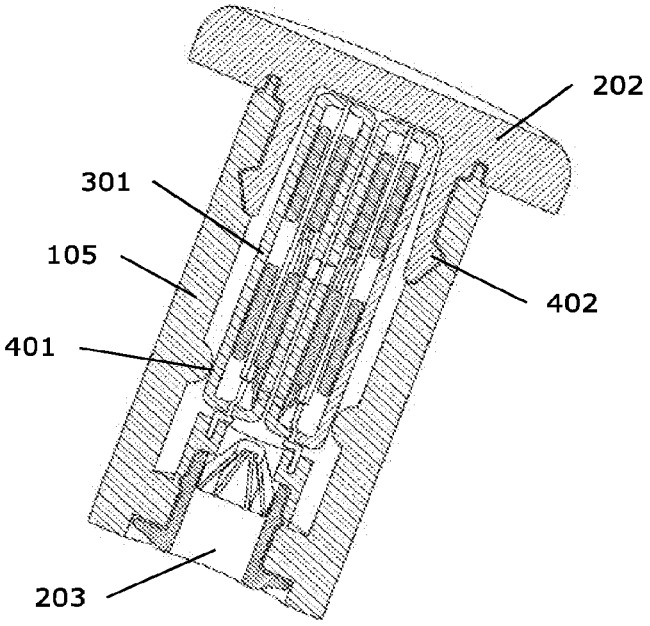
FIG. 4 illustrates a receiver unit for use in a hearing aid according to an embodiment of the invention.

FIG. 4 illustrates a receiver unit 105 for use in a hearing aid according to an embodiment of the invention. The receiver unit comprises a dual receiver 301 hard-mounted to the walls of the receiver unit by a hard-mounted structure 401. The figure further shows the closing member 202 (FIG. 2) attached to the receiver unit 105 by means of snap taps 402. FIG. 4 further shows the sound outlet or spout 203 of the receiver unit 105 from where the sound is guided from the receiver into the chamber or directly to the venting passage. The receiver unit is placed into the compartment of the shell and may connect to the compartment by different means such as by adhesive, press fit or mechanical means. The compartment can be larger than the receiver unit or the receiver unit can fit closely into the compartment. The closing member closes off the compartment structurally and acoustically. The structure 401 can alternatively be an elastomeric structure, such as an elastomeric strip or ribbon that encircles the receiver unit 105.

Figure 5:
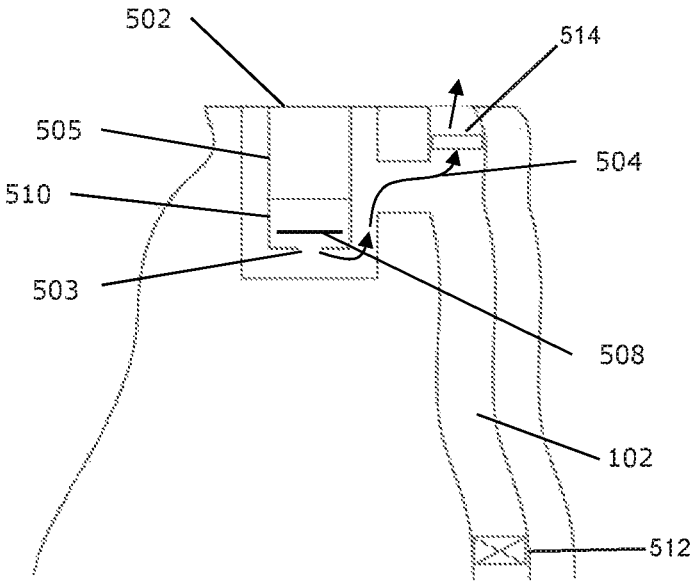
FIG. 5 shows in a cross-sectional view a sketch of another hearing aid device according to the invention.

FIG. 5 illustrates an embodiment with a receiver unit 505 having a receiver 510 in a so-called top-fire configuration. In this configuration, the spout 503 of the receiver 510 is positioned above the diaphragm 508 and outputs sound in a direction perpendicular to the diaphragm 508. The receiver unit 505 is positioned such that the spout 503 is directed away from the closing member 502. The sound is guided through the venting passage 102 as indicated by arrows 504. In this particular embodiment, an additional vibration reduction is obtained as the force created by the sound pressure works against the force generated by the moving mass of the armature and membrane. FIG. 5 also illustrates a damper 512 placed in the venting passage 102 between the second face and the acoustical channel segment that connects to the compartment, and a wax protection mechanism 514 placed in the venting passage 102 between the first face and the acoustical channel segment that connects to the compartment.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A device for emitting sound to an ear of a user, comprising:

a shell adapted to fit within an ear canal of the user and including a compartment therein, the shell having a first face for facing toward an interior of the ear and a second face for facing toward the surroundings of the user, the shell providing a venting passage between the first and second faces for permitting air to pass between the first and second faces, the first face including an opening that leads to the compartment;

a closing member positioned at the opening for closing off the compartment; and a receiver unit mounted within the compartment by suspension elements, the opening of the first face being shaped to allow the receiver unit to be inserted into the compartment though the opening, the compartment being acoustically connected to the venting passage such that sound emitted by the receiver unit is guided from the compartment and out of the shell via the venting passage.

2. A device according to claim 1, wherein the suspension elements include elastomeric structures that partly encircle the receiver unit.

3. A device according to claim 1, wherein the suspension elements include elastomeric structures that fully encircle the receiver unit.

4. A device according to claim 3, wherein the elastomeric structures include one of the group consisting of boots, strips, and ribbons.

5. A device according to claim 1, wherein the suspension elements include shock absorbing protrusions positioned between the receiver unit and walls of the compartment.

6. A device according to claim 1, wherein the suspension elements attenuate mechanical vibrations of the receiver unit.

7. A device according to claim 1, wherein the closing member comprises a lid or plug releasably attached to the shell.

8. A device according to claim 1, wherein the receiver unit is attached to the closing member.

9. A device according to claim 1, wherein the receiver unit is releasably mounted in the compartment and is retractable from the opening on the first face of the shell.

10. A device according to claim 1, wherein the device is a hearing aid device.

11. A device according to claim 1, wherein the receiver unit comprises a sound outlet oriented in a direction away from the first face.

12. A device according to claim 1, wherein the receiver unit comprises either one of a dual receiver, or a combination of a woofer and a tweeter.

13. A device according to claim 1, wherein the compartment is acoustically connected to the venting passage via an acoustical channel segment.

14. A device according to claim 13, further comprising a damper placed in the venting passage between the second face and the acoustical channel segment that connects to the compartment.

15. A device according to claim 13, further comprising a wax protection mechanism placed in the venting passage between the first face and the acoustical channel segment that connects to the compartment.

16. A device for emitting sound to an ear of a user, comprising:

a shell adapted to fit within an ear canal of the user and including a compartment therein, the shell having a first face for facing toward an interior of the ear and a second face for facing toward the surroundings of the user, the first face including an opening that leads to the compartment, the shell including a venting passage extending between the first face and the second face, the compartment being acoustically connected to the venting passage such that sound emitted by the receiver unit is guided from the compartment and out from the first face via the venting passage;

a closing member that closes the opening on the first face; and a receiver unit that is releasably mounted within the compartment such that the receiver unit can be retracted from the shell, the opening on the first face being shaped to allow the receiver unit to be inserted into the compartment.

17. A device according to claim 16, wherein the closing member comprises a lid or a plug that is releasably attached to the shell.

18. A device according to claim 16, wherein the receiver unit is retractable from the opening on the first face of the shell.

19. A device according to claim 16, wherein the receiver unit comprises a sound outlet oriented in a direction away from the first face.

20. A device according to claim 16, wherein the device is a hearing aid device.

21. A device according to claim 16, wherein the receiver unit is releasable mounted within the compartment through suspension elements.

22. A device for emitting sound to an ear of a user, comprising:

a shell adapted to fit within an ear canal of the user and including a compartment therein, the shell having a first face for facing toward an interior of the ear and a second face for facing toward the surroundings of the user, the shell providing a venting passage between the first and second sides that provides air passage between the first and second sides, the shell including an opening that leads to the compartment;

a closing member positioned at the opening for closing off the compartment; and a receiver unit located within the compartment, the opening being shaped to allow the receiver unit to be inserted into the compartment though the opening, the receiver unit including a sound outlet oriented in a direction away from the first face, and the compartment being acoustically connected to the venting passage such that sound emitted by the receiver unit is guided from the compartment and out of the shell via the venting passage.

* * * * *